US005588366A

United States Patent [19]

Loffler

[11] Patent Number: 5,588,366

[45] Date of Patent: Dec. 31, 1996

[54] METHOD OF MONITORING THE WEAR ON PRINTING FORMS IN A PRINTING MACHINE

[75] Inventor: Gerhard Löffler, Walldorf, Germany

[73] Assignee: Heidelberger Druckmaschinen AG, Heidelberg, Germany

[21] Appl. No.: 425,825

[22] Filed: Apr. 20, 1995

[30] Foreign Application Priority Data

Apr. 20, 1994 [DE] Germany ..... 44 13 736.2

[51] Int. Cl.[6] ..... B41F 33/02

[52] U.S. Cl. ..... 101/484; 101/450.1; 101/DIG. 45; 101/170; 101/211

[58] Field of Search ..... 101/141, 145, 101/450.1, 170, 211, 216, 174, 247, 483, 484, DIG. 45, 185

[56] References Cited

U.S. PATENT DOCUMENTS

| | | | |
|---|---|---|---|
| 3,958,509 | 5/1976 | Murray et al. | 101/365 |
| 4,553,478 | 11/1985 | Greiner et al. | 101/484 |
| 4,627,346 | 12/1986 | Dietzell et al. | 101/170 |
| 5,010,820 | 4/1991 | Löffler | 101/484 |
| 5,014,618 | 5/1991 | Zingher et al. | 101/365 |
| 5,050,994 | 9/1991 | Kipphan et al. | 356/445 |
| 5,272,971 | 12/1993 | Fredericks | 101/136 |
| 5,520,113 | 5/1996 | Joss et al. | 101/484 |

FOREIGN PATENT DOCUMENTS

| | | | |
|---|---|---|---|
| 0357987 | 3/1990 | European Pat. Off. . | |
| 80046 | 11/1971 | German Dem. Rep. . | |
| 3101243 | 10/1983 | Germany . | |
| 0244543 | 10/1991 | Japan | 101/484 |

OTHER PUBLICATIONS

Japanese Patent Abstract No. 59–12465, Kunii, dated Jan. 26, 1984.

Japanese Patent Abstract No. 62–227749, dated Oct. 6, 1987.

*Primary Examiner*—Christopher A. Bennett

*Attorney, Agent, or Firm*—Herbert L. Lerner; Laurence A. Greenberg

[57] ABSTRACT

The wear on printing forms in a printing machine is monitored in that the inking values at certain locations on the printed product are measured. At least two measurement locations are defined on the print image. The first measurement location has a defined tonal value above an upper tonal value, and the second measurement location has a tonal value below a lower tonal value. The printed product is scanned as it leaves the printing unit. The measured inking values at the measurement locations are compared with the setpoint values as defined by the tonal values at the defined locations. If the lower tone signal is below the setpoint signal while the upper tone signal corresponds or exceeds the setpoint inking values, the control unit deduces that the printing plate may be worn. The printed product count may be used as auxiliary information in the wear determination.

2 Claims, 2 Drawing Sheets

METHOD OF MONITORING THE WEAR ON PRINTING FORMS IN A PRINTING MACHINE

BACKGROUND OF THE INVENTION

1. Field of the Invention

The invention relates to a method of monitoring and controlling the wear on printing forms in a printing machine, in particular during the printing of large volume print jobs.

Every printing form is subject to a mechanical abrasion/wear during printing, which shows in color and/or brightness variations in the print image. The measurement-technological evaluation of auxiliarly printed measurement fields leads to values in the raster tone values of the raster tone fields which are too low. The measurement fields are produced at the edge of the printed material in the print control strip, whereby the control of wear on the printing form depends on the attentiveness and the experience of the operator for the printing machine.

Besides the subjectivity which is present in the control it is disadvantageous that these measurement fields are not representative of the wear on the entire printing form.

SUMMARY OF THE INVENTION

It is accordingly an object of the invention to provide a method of monitoring and controlling the wear on printing forms in a printing machine, which overcomes the above-mentioned disadvantages of the heretofore-known methods of this general type and which allows continuous, automatic monitoring and control of the wear on printing forms.

With the foregoing and other objects in view there is provided, in accordance with the invention, a novel method of monitoring wear on printing forms in a printing machine. The method comprises the following steps:

- defining a first measurement location on a print image, the first measurement location having a defined first tonal value above a given upper tonal value;
- defining a second measurement location on the print image, the second measurement location having a defined second tonal value below a given lower tonal value;
- scanning, with an image recording device, a printed image on a printed surface of a print product at the first and second measurement locations;
- producing image signals of the first and second measurement locations with the image recording device and supplying the image signals to a control unit; and
- deducing, from the image signals, wear on the printing forms and outputting signals representing the wear with the control unit. Outputting may be in the form of an audible and/or visible alarm signal, or it may be a continuous numerical and graphical display regarding the wear information.

In other words, signals representing the print image are produced with at least one image recording device and fed to a control or regulating device. At least one measurement location is disposed at a tone region above a defined upper tonal value and at least one further measurement location is disposed at a tone region below a defined tonal value.

At least one signal regarding the wear of the printing form is derived and output from the image signals obtained from these measurement locations with the aid of the control or regulating device.

In accordance with another mode of the invention, the method further comprises counting the printed product with a counter and including a count of the printed product counter as auxiliary information in the deducing step. In other words, for improving the dependability of the wear control it is possible to supply the control and regulating device with auxiliary signals, in particular the counter value of a circulation counter (number of copies printed), which can be linked with the signals of an image recording device by means of a programmed system. Further auxiliary signals may be obtained from devices which contain the signals for ink and damping medium supply in the offset print and signals for the pressure on the cylinders taking part in the printing. Such information is generally available in digital form in modern printing machines, such as in the CPC system of Heidelberger Druckmaschinen AG. It is possible to check with the aid of these auxiliary signals whether or not the signal output by the control or regulating device is indeed significant for the wear on a printing form. With the aid of the signal for the wear on a printing form it is possible to actuate optical or acoustic alarms. It is also possible to continuously display a degree of wear on a printing form numerically or graphically.

The measurement values for the image recording device can be derived from signals representing the print image. It is thereby possible to use signals which are directly obtained by scanning the print image within or outside of the printing machine.

Certain hardware is required in the method according to the invention. Such hardware concerning particularly image recording, image processing and auxiliary signal generation is disclosed in detail in several recent publications by Heidelberger Druckmaschinen AG of Heidelberg, Germany. Details may be found in international publications WO 95/00336 A2 (PCT/EP94/02078); WO 95/00335 A1 (PCT/EP94/ 2033); and German patent publication DE 43 21 180 A1. These publications are herein incorporated by reference.

Other features which are considered as characteristic for the invention are set forth in the appended claims.

Although the invention is illustrated and described herein as embodied in a method of monitoring and controlling the wear on printing forms in a printing machine, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
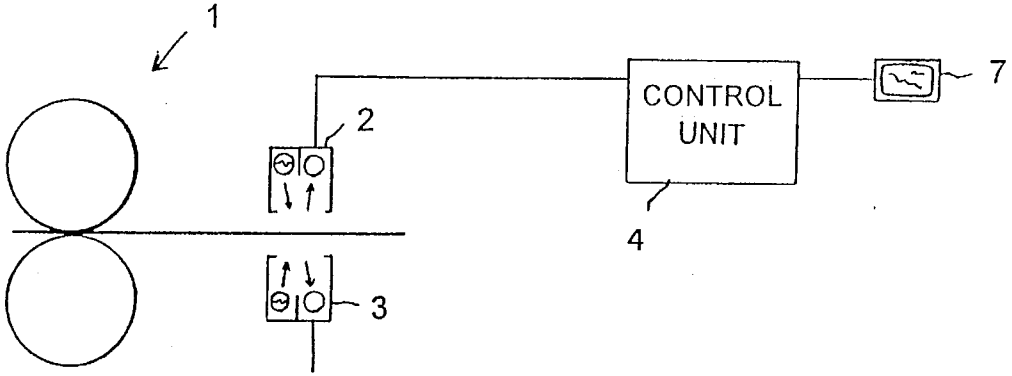
FIG. 1 is a diagrammatic side view of a printing unit and a control unit.
Figure 2:
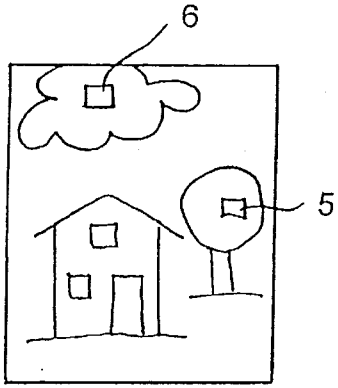
FIG. 2 is a diagrammatic representation of a print image.

Referring now to the figures of the drawing in detail and first, particularly, to FIG. 1 thereof, there is seen an image recording device located after the last printing unit 1 of a multi-color offset printing machine (as seen in the printed product travel direction indicated by the arrow). The image recording device includes a scanner 2 (light source and opto-electric receiver), which scans the full surface of the print image produced with the printing machine. In perfector printing machines there are provided two image recording devices, i.e. two scanners 2 and 3, which simultaneously scan the front and the back of the print material. The image signals are supplied to a control unit 4 or regulating device 4, which is provided for controlling or regulating all possible operational steps at the printing machine. The image information from the scanner indicates the surface of the printed product in a coordinate system. Accordingly, it is possible to obtain information regarding the entire print image and to transmit the corresponding signals to the main control unit (cf. WO 95/00336). The signals of at least two measurement locations 5 and 6, which were previously determined, are evaluated in the control unit 4.

It is advantageous if at least one predetermined measurement location, say, the location 5, has a tonal value above 50% and the further measurement location 6 has a tonal value of less than 20%. Respective measurement values for inking are derived from the measurement values at these measurement locations 5 and 6.

The measurement values (5' and 6') for inking are processed in a program, wherein it is determined whether or not, while the tones above the 50% tonal value are inked sufficiently, the light tones below the 20% tonal value are not inked enough. If this is the case, the program continues by evaluating the number of prints which have been produced with the printing form. When a certain number has been reached it is likely that the printing forms have been worn off. The control or regulating device then issues an acoustic signal which indicates to the printing machine operator that the printing forms should be exchanged.

If the control or regulating device is equipped with a display unit it is possible to display the degree of wear and the accompanying change on the printing forms numerically or graphically, e.g. continuously, for the individual printing units.

Figure 3:
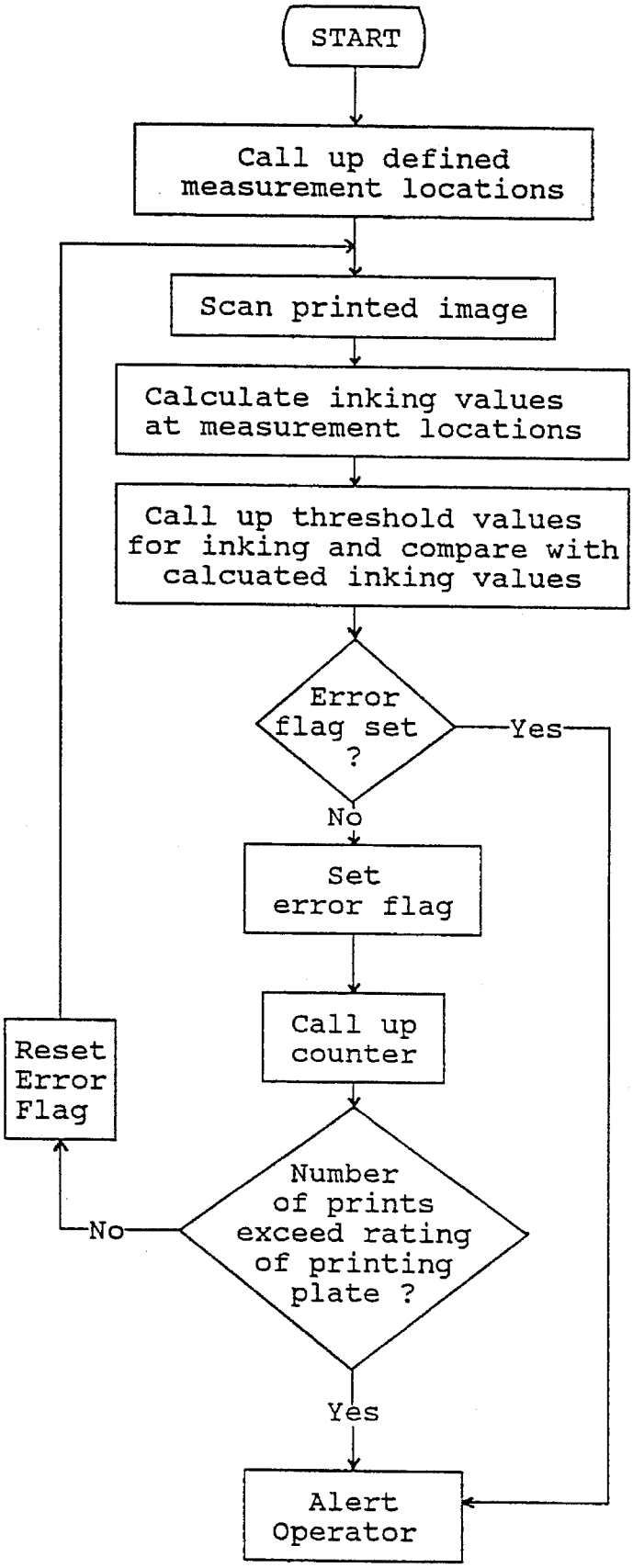
FIG. 3 is a flow chart illustrating an exemplary processing program.

With reference to FIG. 3, an exemplary program is synchronized with the printing unit such that each loop corresponds to the arrival of a newly printed image from the printing unit 1. The measurement locations 5 and 6 can be defined manually or automatically. In the former case, the image is displayed on the screen and the operator marks the measurement locations, for instance by clicking at any arbitrary cursor positions. In the latter case, the image is recalled from the raster image definition which is available in the main control unit 4 and an algorithm is used to select any one location on the image which has the desired tonal values. The scanning result at the two locations 5 and 6 is first converted into respective inking values, which are then compared with the setpoint values for inking at those locations. As long as the comparison leads to a satisfactory result (PASS), the program loops back to scan the next printed image.

If the comparison fails (FAIL), the printed product counter is consulted in an effort to query whether or not the number of printed copies exceeds the rating of the printing plate. If this is affirmative, the operator is alerted in a final step. If the query finds that the counter is at a lower number than the print copies which should be attained with the printing plate, then the program may loop back to the scan instruction on the assumption that the detected error was caused by some chance signal deviation. If the comparison during the next following loop fails again, the error flag is encountered immediately, and the operator alert is triggered.

I claim:

1. A method of monitoring wear on printing forms in a printing machine, which method comprises:

defining a first measurement location on a print image, the first measurement location having a defined first tonal value above a given upper tonal value;

defining a second measurement location on the print image, the second measurement location having a defined second tonal value below a given lower tonal value;

scanning, with an image recording device, a printed image on a printed surface of a print product at the first and second measurement locations;

producing image signals of the first and second measurement locations with the image recording device and supplying the image signals to a control unit; and deducing, from the image signals, wear on the printing forms and outputting signals representing the wear with the control unit.

2. The method according to claim 1, which further comprises counting the printed product with a counter and including a count of the printed product counter as auxiliary information in the deducing step.

* * * * *